US010271619B1

(12) United States Patent
Peck

(10) Patent No.: US 10,271,619 B1
(45) Date of Patent: Apr. 30, 2019

(54) FLEXIBLE RING STRUCTURE FOR JEWELRY

(71) Applicant: Keven Peck, New York, NY (US)

(72) Inventor: Keven Peck, New York, NY (US)

( * ) Notice: Subject to any disclaimer, the term of this patent is extended or adjusted under 35 U.S.C. 154(b) by 0 days.

(21) Appl. No.: 15/896,604

(22) Filed: Feb. 14, 2018

Related U.S. Application Data

(60) Provisional application No. 62/510,319, filed on May 24, 2017.

(51) Int. Cl.
*A44C 5/08* (2006.01)
*A44C 9/02* (2006.01)

(52) U.S. Cl.
CPC . *A44C 5/08* (2013.01); *A44C 9/02* (2013.01)

(58) Field of Classification Search
CPC ..... A44C 5/02; A44C 5/022; A44C 5/025; A44C 5/04; A44C 5/08
USPC ..... 63/38, 5.2; 59/80, 82, 79.2
See application file for complete search history.

(56) References Cited

U.S. PATENT DOCUMENTS 311,722 A * 2/1885 Cottle ..... A44C 5/08 59/79.2
1,660,438 A * 2/1928 John Fielding ..... A44C 5/08 59/79.2
3,066,501 A * 12/1962 Charles ..... A44C 11/002 24/574.1

* cited by examiner

*Primary Examiner* — Abigail E Troy
(74) *Attorney, Agent, or Firm* — Levisohn Berger LLP

(57) ABSTRACT

The invention provides a flexible ring structure made of loosely-linked prisms, which together define an interior channel. A tensioned spring runs through the length of the channel. The ring, which gives the appearance of a solid and rigid circular structure, can be compressed so as to conform to the cross-section of the finger or hand, and springs back to a circular shape when released. The invention makes it possible to wear an Eternity Ring or a bracelet of smaller diameter than could otherwise be put on the wrist.

10 Claims, 3 Drawing Sheets

FLEXIBLE RING STRUCTURE FOR JEWELRY

REFERENCE TO PRIOR APPLICATION

This application claims priority of U.S. Provisional patent application Ser. No. 62/510,319, filed May 21, 2017, the contents of which are incorporated herein by reference.

FIELD OF THE INVENTION

The invention is in the field of jewelry, more specifically rings, bracelets, necklaces, and other decorative bands.

BACKGROUND

Typical rings are of a fixed structure and must be sized. This can diminish a customer experience who continues to wear an improperly fitting ring or is unwilling to have it resized. The solid ring has the attractive feature of presenting a richer and more solid appearance. For round structures used in bracelets, they must be left with an opening, or be provided with a hinge and a latch, in order to be put over the wrist. Such solutions are not useful when the appearance of a continuous circular band is desired. The design choice of an oversized bracelet or bangle that can be slipped over the hand is not always desirable. Rigid bracelets must be made considerably over-sized, as their circular shape does not conform to the actual cross-section of the hand; specifically, the diameter of the bracelet must be large enough to fit the width of the hand. The present invention provides a flexible ring structure having a solid and rigid appearance that is capable of expanding to slip on a ring or wrist and springs back to a circular shape when released. For rings, this is an unusual structure.

Prior art expandable bracelets exist, but none have the secure interlocking structure of the individual elements of this invention. Jewelry rings fit on the finger and are rarely made of an expandable ring structure.

BRIEF DESCRIPTION OF THE INVENTION

The invention provides a decorative ring structure in the form of a chain of linked trapezoidal prisms. The prisms are non-rigidly linked and are capable of relative motion. Passages through each of the prisms are aligned so as to define a torus-shaped passage extending through the length of the chain. A tensioned core spring is disposed within the passage, and provides an inward force that serves to keep the prisms pressed together into a rigid, circular arrangement when the band is unstressed. Upon the application of an external force, the freedom of relative motion between the prisms, together with the elasticity of the core spring, permits the ring structure to flex to fit on a wearer's finger or wrist.

DETAILED DESCRIPTION OF THE INVENTION

Figure 1:
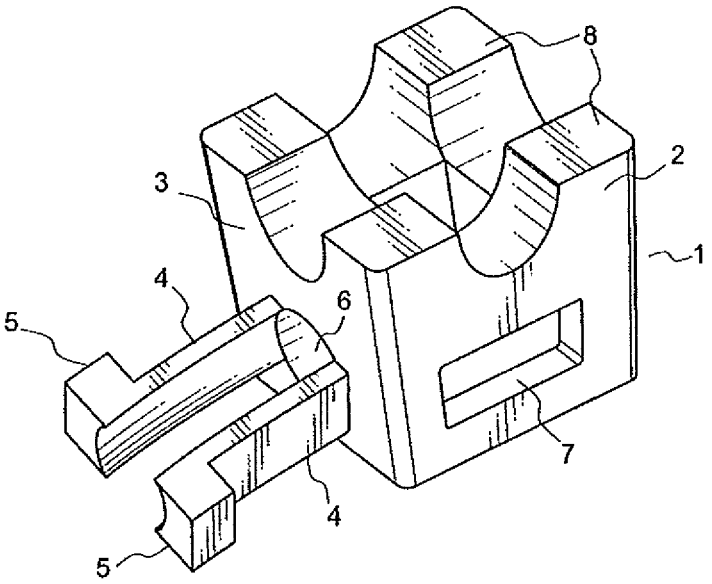
FIG. 1 shows a trapezoidal prism of the invention in perspective.

The invention provides a chain which has a plurality of linked trapezoidal prisms. Each prism has two trapezoidal side faces, a front face, a rear face, two prongs, and a passage extending from the front face through the rear face. Furthermore, each side face has a side opening, and each rear face has a rear opening. The prongs extend from the front face on opposite sides of the passage, and outward-directed barbs are disposed at the ends of the prongs. The barbs are sized to fit within the side openings. The prior art, even for expandable jewelry, does not have such structures.

To form the chain, the prongs of one prism are inserted into the rear opening of the next prism, until the barbs engage with the side openings of the adjacent prism so as to retain the barbs and prevent separation of the prisms. In order to permit a useful degree of relative motion of the prisms and provide a flexible chain, the attachment is not rigid. This can be ensured by appropriately sizing the prongs, and appropriately sizing and positioning the side openings, so as to leave some slack in the connection between the prisms. By way of example, between about 0.5 mm and about 1.0 mm (0.02 to 0.04 inches) of relative motion usually provides adequate flexibility, but the practitioner can depart from these values if it is desirable to do so. The preferred amount of slack will vary with the size of the prisms and the length of the chain.

When the prisms are thus chained together into a ring, the passages through the prisms are aligned with one another so as to form a torus-shaped channel. A helical spring extends through the channel, i.e. through the passages of the linked prisms; and is tensioned and fixed in place.

In a first embodiment, the ends of the tensioned spring are affixed to the ends of the chain. The tension of the spring then biases the ends of the chain toward each other, thereby holding the prisms in contact with one another. To form a bracelet, the ends of the chain are brought together and fastened to one another. For prisms made from metal, welding or soldering are the preferred methods of affixing the ends of the chain to one another. In a preferred method of manufacture, the prongs are removed from one end of the chain prior to soldering the ends together, in order to simplify assembly.

In a second embodiment, the spring is passed through the interior passage of the chain, and is stretched out sufficiently to permit the ends of the spring to be fastened together. This can be done, for example, by soldering, by the use of a clip or similar device, by bending the ends of the springs into mutually engaged hooks, or by soldering the two ends if the spring into the interior of a single prism. The tension of the spring biases the circular chain inward, toward a smaller circumference, thereby holding the prisms in contact with one another.

The trapezoidal shape of the prisms causes the chain, when compressed by the tensioned spring, to adopt a curved shape. The angle of the sloped (front and rear) sides of the prisms determines the number of prisms that define a full circle, and it will generally be preferred that this is the number of prisms used in the chain. For a desired number n of prisms, the front and rear sides of each prism should subtend an angle $\theta=360°/n$.

Turning to the drawings, particular embodiments are illustrated.

FIG. 1 is a perspective view of a trapezoidal prism 1 of the invention, in which a side face 2 and front face 3 are visible. Prongs 4, terminated with barbs 5, extend from front face 3 on either side of the passage 6. Side face 2 features side opening 7. This particular embodiment features four posts 8 on the upper face. The posts are used to secure a gem stone, which is placed in the middle of the upper face and fixed in place by bending the posts inward, in the usual manner of affixing gems to jewelry. For a ring, having gem stones in each prism provides an "Eternity" ring with diamonds all around, but with a unique sizing feature. In alternative embodiments, the upper face may be a polished or decorated surface.

The prism may be manufactured by methods known in the art. A preferred method is investment casting, wherein a number of wax or polymer patterns of the prism are prepared, for example by CNC machining or 3-D printing, and attached to a sprue to form a tree. The patterns are chased and dressed, if necessary, and an investment (mold) material is applied and hardened. The wax or polymer is then removed by melting and/or vaporization. Alternatively, the mold may be 3-D printed directly, obviating the need to prepare patterns.

The desired metal, for example gold, silver or an alloy thereof, is poured, injected, or vacuum-drawn into the mold and allowed to solidify. The casting is released by the appropriate means, depending on the mold material, and the cast prisms are cut from the sprue and finished by grinding and polishing. If the prism is cast in a base metal, a precious metal plating or overlay may be applied.

Figure 2:
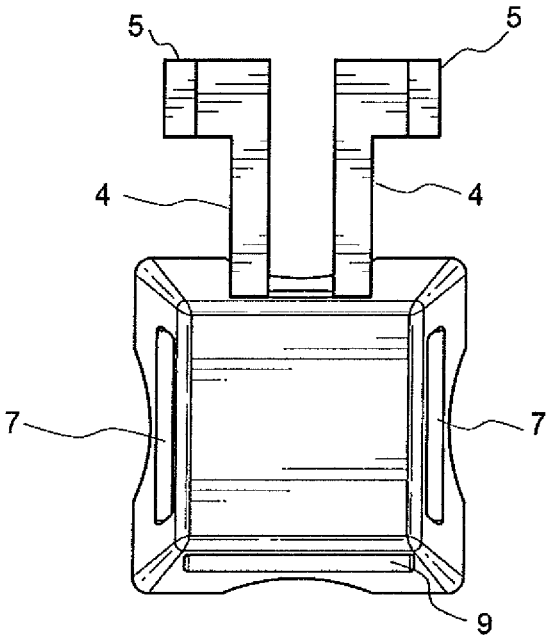
FIG. 2 is a bottom view of a trapezoidal prism of the invention.

FIG. 2 is a bottom view of a prism, in which rear opening 9 is visible.

Figure 3:
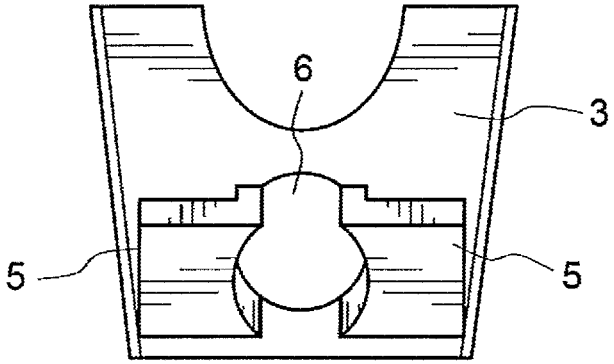
FIG. 3 is a front view of a trapezoidal prism of the invention.

FIG. 3 is a front view of the prism of FIG. 1, showing how the passage 6 extends through the entire prism. The passage continues on a slight downward arc between the prongs. The purpose of the passage is to accommodate the helical spring, which is bent into a circle; therefore the radius of the arc should approximate the radius of the final circular band or bracelet. The prongs in this preferred embodiment have facing cylindrical surfaces that are congruent with the torus-shaped passage collectively defined by the prisms.

Figure 4:
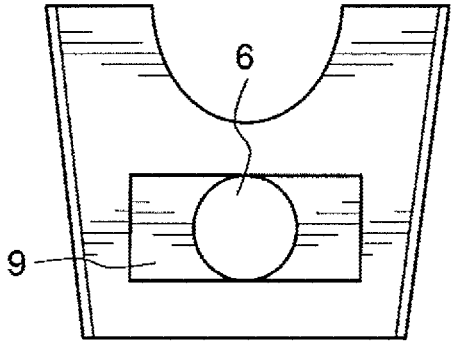
FIG. 4 is a rear view of a trapezoidal prism of the invention.

FIG. 4 is a rear view of the prism, showing the rectangular rear opening 9. The rear opening must be sized to permit entry of the prongs and barbs, when the prongs are bent toward one another. In practice, the prism will typically be made of a jewelry metal such as gold or silver, or a base metal with a gold or silver overlay. These metals and their alloys are generally malleable and have low resilience, so that the prongs 4 can be bent together, inserted into the rear opening of a second prism, and then bent back outward so that the barbs 5 enter the side openings 7 of the second prism and remain there. The latter step is accomplished through the open top of the second prism, or by reaching through the side openings 7 with a hook to pull the prongs outward. To the extent that a metal having greater resilience is employed, it is expected that the prongs will be held together while being inserted and will have the ability to spring back after insertion.

Figure 5:
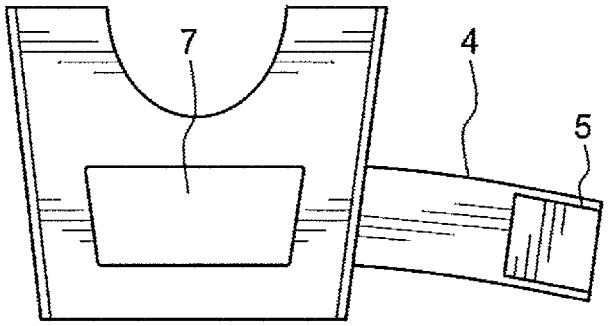
FIG. 5 is a side view of a trapezoidal prism of the invention.

FIG. 5 is a side view of the prism shown in FIG. 2, showing the downward arc of the prongs. In this embodiment, the barbs are smaller in height than the prongs, whereas the embodiment shown in FIGS. 1 and 3 employs barbs equal in height to the prongs. The former embodiment permits less relative rotation of the prisms than the latter. In any embodiment, the height of the side openings 7 must be sufficient to accommodate the barbs 5.

Figure 6:
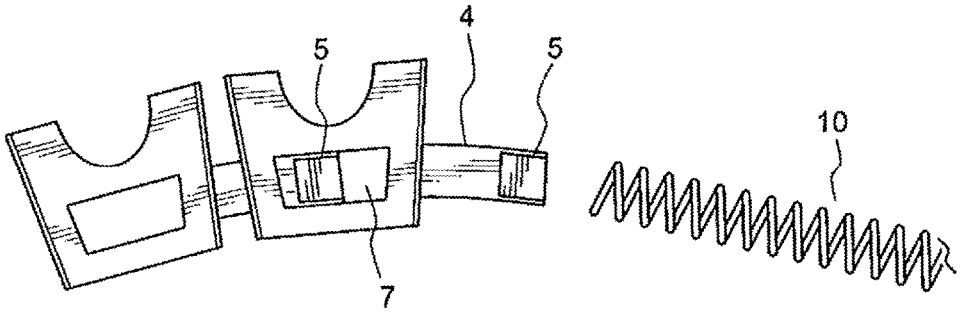
FIG. 6 is a side view of two linked trapezoidal prisms of the invention, and a section of the core spring aligned with the central passage.

FIG. 6 is a side view of two prisms which have been linked as describe above. Also shown is the terminal portion of a helical spring 10, aligned with the passages of the prisms.

Figure 7:
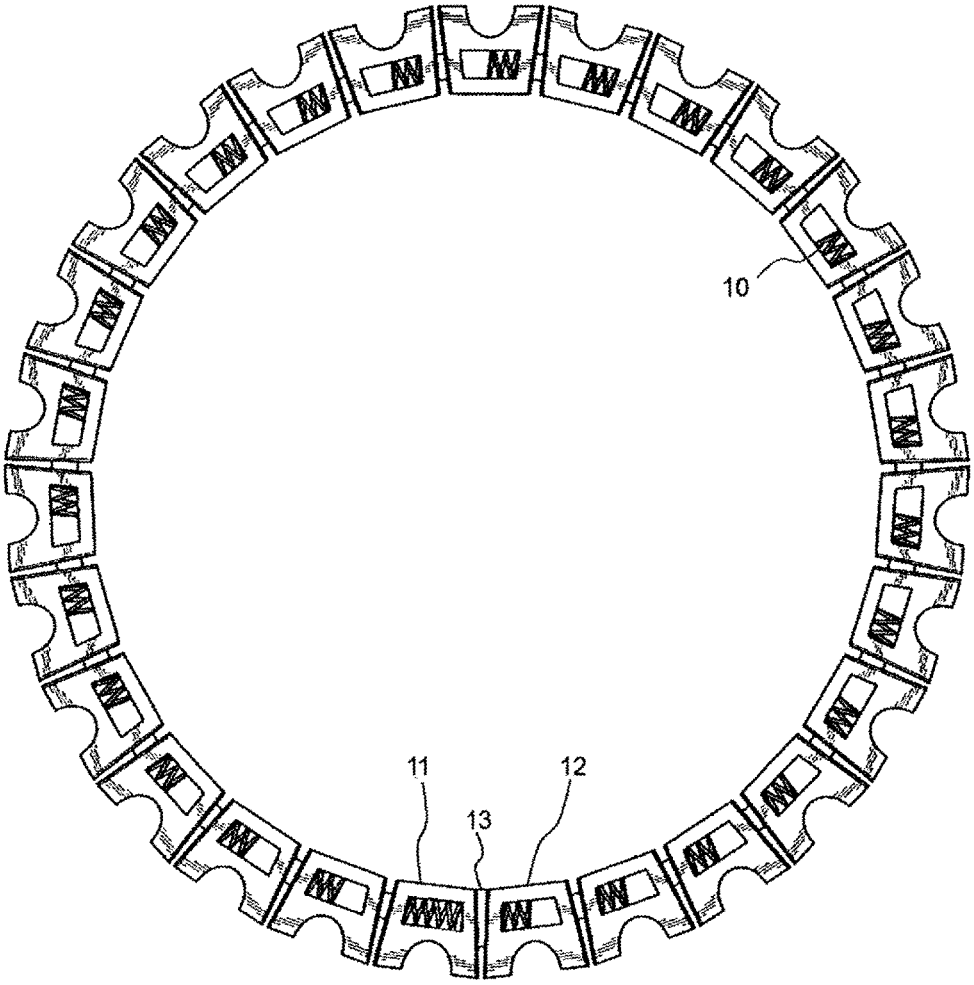
FIG. 7 is a side view of a complete band of the invention, consisting of 27 linked trapezoidal prisms and a core spring.

FIG. 7 shows a fully-assembled ring structure according to one embodiment of the invention, comprising 27 individual prisms. This embodiment can be assembled by linking the prisms into a chain, then threading the spring 10 through the aligned passages. One end of the spring is soldered to the interior of the first link 11, and the spring is stretched to introduce the desired amount of tension. The tensioned spring is then soldered within terminal link 12. The prongs and excess length of spring are cut from terminal link 12, and links 11 and 12 are joined by solder joint 13.

As noted above, there are alternative embodiments of the invention which employ variations on the assembly method. In one variant, the ends of the spring are both soldered into the same prism, prior to making the final linkage. In another variant, the ends of the spring are soldered or hooked together. Other variations may be employed; a feature to be maintained is that the spring is permanently held in tension and passes through essentially all of the prisms.

The amount of tension on the spring should be sufficient to hold the prisms in a rigid arrangement during normal use, but it otherwise not critical, and can be selected to obtain the desired stiffness of the final product. The spring can be of any appropriate material, but will typically be a commercially available spring made of spring steel wire.

The mounting of the gemstones to the prisms can be accomplished at any time, but for ease of assembly it is preferably done after the prisms are linked into the chain. Mounting of the gemstones to the first and terminal links is preferably carried out after the spring has been soldered into place.

The present specification and drawings will make the advantages of the present invention apparent to those skilled in the art, and it will be recognized by those skilled in the art that changes or modifications may be made to the described embodiments without departing from the broad inventive concepts of the invention. It should therefore be understood that this invention is not limited to the particular embodiments described and illustrated herein, but is intended to include all changes and modifications that are within the scope and spirit of the invention as set forth in the claims.

I claim:

1. A chain to form an expandable ring structure, said chain having a first end and a second end, comprising a plurality of linked trapezoidal prisms, each prism having two trapezoidal side faces, a front face, a rear face, two prongs, and a passage extending from the front face through the rear face, wherein (a) each side face has a side opening;

(b) each rear face has a rear opening;

(c) on each prism, the prongs extend from the front face and are disposed on opposing sides of the passage;

(d) outward-directed barbs are disposed at the ends of the prongs;

(e) the prongs of each prism extend through the rear opening of an adjacent prism, each barb thereby being engaged within a side opening of the adjacent prism;

(f) a helical spring extends through the passages of the linked prisms; and (g) the spring is affixed to the ends of the chain and is in tension;

wherein engagement of the barbs of a prism with the side openings of the adjacent prism retains the prongs and prevents separation of the prisms, and the tension of the spring biases the ends of the chain toward each other, thereby holding the prisms in contact with one another.

2. The chain according to claim 1, further comprising, at the second end of the chain, a terminal trapezoidal prism having two trapezoidal side faces, a front face, a rear face, and a rear opening in the rear face; wherein:

(a) one end of the spring is affixed to the terminal trapezoidal prism;

(b) the front face of the terminal trapezoidal prism is affixed to the rear face of the trapezoidal prism at the first end of the chain.

3. The chain according to claim 2, wherein the front face of the terminal trapezoidal prism is permanently affixed to the rear face of the trapezoidal prism at the first end of the chain.

4. The chain according to claim 1, wherein said chain forms a jewelry ring.

5. The chain according to claim 4, wherein said jewelry ring is an Eternity Ring.

6. A circular chain, comprising a plurality of linked trapezoidal prisms, each prism having two trapezoidal side faces, a front face, a rear face, two prongs, and a passage extending from the front face through the rear face, wherein (a) each side face has a side opening;

(b) each rear face has a rear opening;

(c) on each prism, the prongs extend from the front face and are disposed on opposing sides of the passage;

(d) outward-directed barbs are disposed at the ends of the prongs;

(e) the prongs of each prism extend through the rear opening of an adjacent prism, each barb thereby being engaged within a side opening of the adjacent prism;

(f) a helical spring extends through the passages of the linked prisms;

(g) the two ends of the spring are affixed to each another, and (h) the spring is in tension;

wherein engagement of the barbs of a prism with the side openings of the adjacent prism retains the prongs and prevents separation of the prisms, and the tension of the spring biases ends of the chain toward each other, thereby holding the prisms in contact with one another.

7. The chain according to claim 6, further comprising, at one of the ends of the chain, a terminal trapezoidal prism having two trapezoidal side faces, a front face, a rear face, and a rear opening in the rear face; wherein:

(a) one end of the spring is affixed to the terminal trapezoidal prism;

(b) the front face of the terminal trapezoidal prism is affixed to the rear face of the trapezoidal prism at another of the ends of the chain.

8. The chain according to claim 7, wherein the front face of the terminal trapezoidal prism is permanently affixed to the rear face of the trapezoidal prism at the other of the ends of the chain.

9. The chain according to claim 6, wherein said chain forms a jewelry ring.

10. The chain according to claim 9, wherein said jewelry ring is an Eternity Ring.

* * * * *